US009654888B2

(12) United States Patent
Harris

(10) Patent No.: US 9,654,888 B2
(45) Date of Patent: May 16, 2017

(54) PERSONAL HEARING DEVICE

(71) Applicant: Axil, LLC, Draper, UT (US)

(72) Inventor: Weston T. Harris, Lindon, UT (US)

(73) Assignee: AXIL, LLC, Draper, UT (US)

( * ) Notice: Subject to any disclaimer, the term of this patent is extended or adjusted under 35 U.S.C. 154(b) by 0 days.

(21) Appl. No.: 14/660,863

(22) Filed: Mar. 17, 2015

(65) Prior Publication Data

US 2015/0264495 A1 Sep. 17, 2015

Related U.S. Application Data

(60) Provisional application No. 61/954,409, filed on Mar. 17, 2014.

(51) Int. Cl.
*H04R 25/00* (2006.01)

(52) U.S. Cl.
CPC ..... *H04R 25/65* (2013.01); *H04R 2225/025* (2013.01); *H04R 2225/61* (2013.01)

(58) Field of Classification Search
CPC ..... H04R 2460/17; H04R 25/652; H04R 2225/025; H04R 25/658; H04R 2225/06; H04R 2225/611
USPC ..... 381/329, 322, 328, 324; 181/135
See application file for complete search history.

(56) References Cited

U.S. PATENT DOCUMENTS

| | | | | | |
|---|---|---|---|---|---|
| 4,133,984 | A * | 1/1979 | Akiyama | H04R 25/456 | 181/135 |
| 4,539,440 | A * | 9/1985 | Sciarra | H04R 25/656 | 381/321 |
| 4,672,672 | A * | 6/1987 | Eggert | H04R 25/60 | 381/321 |
| 5,003,608 | A * | 3/1991 | Carlson | A61B 5/12 | 381/322 |
| 2010/0142739 | A1* | 6/2010 | Schindler | H04R 25/00 | 381/329 |

* cited by examiner

*Primary Examiner* — Davetta W Goins
*Assistant Examiner* — Phylesha Dabney
(74) *Attorney, Agent, or Firm* — Holland & Hart

(57) ABSTRACT

A universal personal hearing device is described. The universal personal hearing device includes a first microphone, an amplification circuit electrically connected to the first microphone, a speaker electrically connected to the amplification circuit for amplifying ambient sound detected by the first microphone, and a housing having at least one arcuate outer edge. The arcuate outer edge is slidably engageable with the concha wall to provide a universal fit across a variety of ears having different sizes and/or shapes. Other embodiments are described.

23 Claims, 10 Drawing Sheets

PERSONAL HEARING DEVICE

RELATED APPLICATION

This application claims the benefit of U.S. Provisional Application No. 61/954,409, filed on 17 Mar. 2014, the disclosure of which is incorporated, in its entirety, by this reference.

FIELD OF INVENTION

This application relates generally to the field of hearing devices, and more particularly to a hearing device that is usable as a universal personal sound amplifier.

BACKGROUND OF THE INVENTION

The importance of hearing devices in today's society and the need to take care in protecting one's hearing from the very negative effects of hearing loss is becoming more and more apparent. It has been estimated that over 120 million Americans need to hear while working on the job or recreationally. Moreover, professional sources also estimate that over 35 million Americans need to hear better due to hearing loss. However, only 7-8 million of those have been willing to use the current distribution model of a traditional hearing clinic to get help.

There may be a variety of reasons why more people do not take advantage of the different options currently available for hearing enhancement. For example, one reason more people are not getting help may be due to the inefficiencies and expenses associated with the current distribution model of a traditional hearing clinic. In such settings, hearing devices are often customized for use with a particular individual. And, although there may be other options available, such as personal sound amplification products ("PSAP") which can be used to improve hearing performance in a variety of situations, there may still be some disadvantages associated with PSAP products currently available on the market. One such disadvantage is that ear size varies greatly across the general population such that a particular PSAP device that fits comfortable and in a stable fashion in one person's ear is not likely to have the same sort of fit in another person's ear.

SUMMARY OF THE INVENTION

This application describes a universal personal hearing device. The personal hearing device contains a housing having an arcuate outer edge for engaging the concha wall of an ear. The personal hearing also contains a slidable, lockable mechanism that opens and closes a sound valve. In some configurations, the hearing device may be a personal sound amplification product ("PSAP").

According to some aspects, the hearing device may include a first microphone, an amplification circuit electrically connected to the first microphone, a speaker electrically connected to the amplification circuit for amplifying ambient sound detected by the first microphone, and a housing having at least one arcuate outer edge. The arcuate outer edge may be part of a larger circle and configured to align with the concha area when the hearing device is placed in an ear. The arcuate outer edge may allow the housing to slidably engage the concha area of the ear, so that the hearing device is stably and comfortably held in the ear regardless of the size of the particular ear.

In other aspects, the hearing device includes a housing having a first section and a second section, the first section comprising an arcuate outer edge. The arcuate outer edge of the first section may be part of a larger circle and configured to align with the concha area when the hearing device is placed in an ear while the second section aligns to the ear canal.

In yet other aspects, the hearing device includes a housing having a first section with a substantially circular design and a second section with a substantially circular design. In some embodiments, the first section is larger than the second section. Additionally, there may be a transition space between the first section and the second section. An outer edge of the first section may be configured to align with the concha area when the hearing device is placed in an ear while the second section aligns to the ear canal. This two-circle design may allow the hearing device to roll up or down in the outer ear according to whatever the person's ear shape or size is.

In other aspects, the hearing device may have a design that allows for a true unplugged, open feeling while maintaining a small in the ear, hearing device for all ears. For example, the design may include a very slim port that goes into the ear allowing an open ear tip to be placed on it, leaving the ear canal completely open and natural. Alternatively, a foam tip may be placed on the port for maximum hearing protection. This helps provide an affordable, yet highly effective solution, for hearing enhancement or hearing protection to help tens of millions of Americans have easy access to effective solutions for their hearing needs.

In other aspects, the hearing device includes a housing and one or more attachment members for engaging the housing. The attachment member may releasably engage the housing to aid in the retention of the hearing device when the hearing device is placed in an ear.

BRIEF DESCRIPTION OF THE DRAWINGS

Various embodiments of the hearing device are shown and described in reference to the numbered drawings, wherein.

Figure 1:
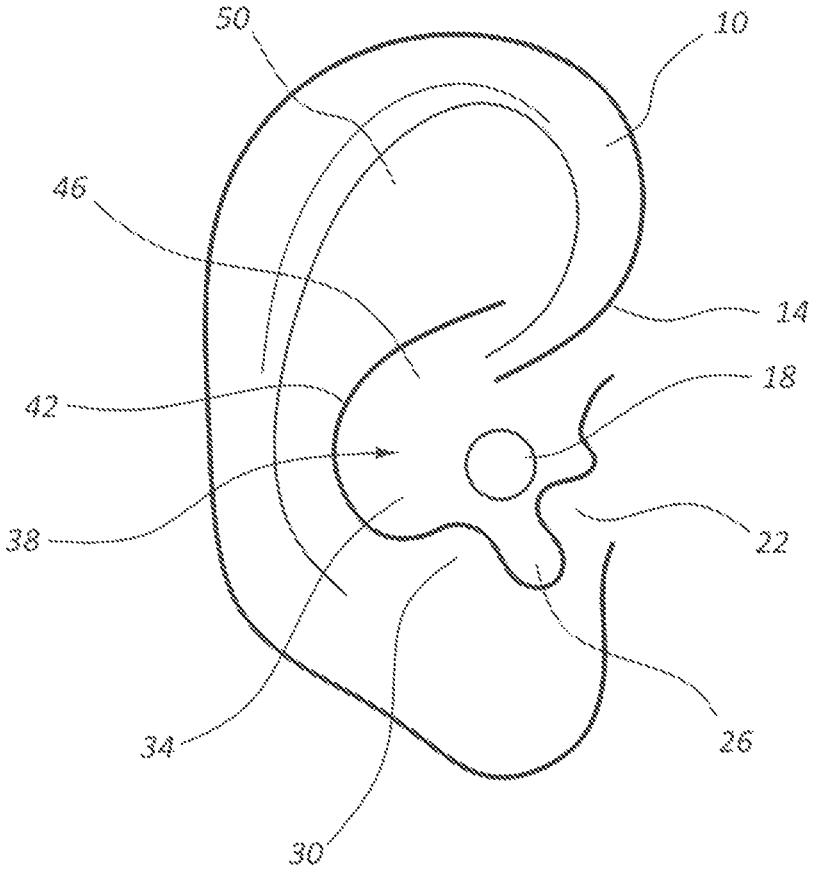
FIG. 1 shows a typical human ear.

Together with the following description, the Figures demonstrate and explain the principles of exemplary hearing devices and associated methods of making and using them. In the Figures, the size and relative placement of components and regions of illustrated devices may be exaggerated or modified for clarity. The same reference numerals in different drawings represent the same element, and thus their descriptions may not be repeated. Some drawings may omit certain components not necessary for describing the illustrated embodiments, but which would be known to those of ordinary skill in the art to be present in and with hearing devices.

DETAILED DESCRIPTION OF THE PREFERRED EMBODIMENT

The following description supplies specific details in order to provide a thorough understanding. Nevertheless, the skilled artisan will understand that the described sensors and associated methods of making and using the sensors can be implemented and used without employing these specific details. Indeed, the sensors and associated methods can be placed into practice by modifying the described systems and methods and can be used in conjunction with any other apparatus and techniques conventionally used in the industry. For example, while the description below focuses on hearing devices used for human ears, they could also be used for non-human ears.

Reference in the specification to "one embodiment" or "an embodiment" means that a particular feature, structure, or characteristic described in connection with the embodiment is included in at least one embodiment. The appearances of the phrase "in one embodiment" in various places may not necessarily limit the inclusion of a particular element to a single embodiment, rather the element may be included in other or all embodiments discussed herein.

Turning now to FIG. 1, for illustration purposes and to aid in the understanding of the placement of the hearing devices, a typical human ear is shown in FIG. 1. The outer ear, or pinna, is an irregularly concave cartilaginous member including a number of eminences and depressions which give each ear a distinct shape and form. The helix 10 is the curved outer rim of the ear. Below the helix 10 is the antihelix 50. The antihelix 50 is a curved prominence which describes a curve around the concha 38, a deep cavity containing the entry to the ear canal 18. The concha 38 is divided into two parts, the upper concha 46 and the lower concha 34, by the crux of the helix 14 which curves around the outside of the ear, and extends inwards at about the vertical midpoint of the ear. The upper concha 46 lies above the crux of the helix 14 and below the antihelix 50. The lower concha 34 lies below the crux of the helix 14 and surrounds the entry to the ear canal 18. The concha wall 42 separates the concha 38 from the antihelix 50. In front of the lower concha 38 and projecting backwards from the front of the ear is the tragus 22, a small semicircular prominence. Opposite the tragus 22 and separated from it by the deep curvature of the intertragic notch 26 is the antitragus 30. The intertragic notch 26 is formed between the tragus 22 and the antitragus 30.

Figure 2A:
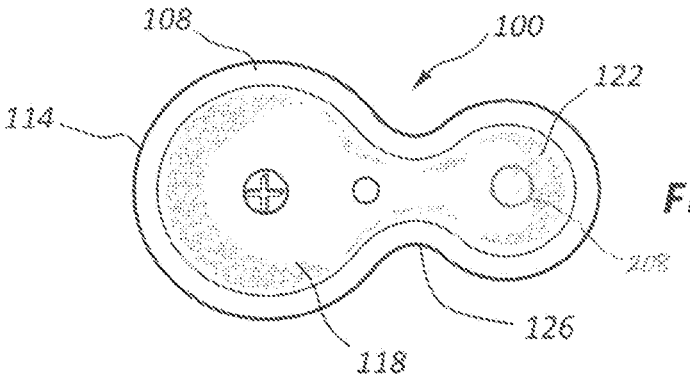
FIG. 2A shows a front view of a hearing device.
Figure 2B:
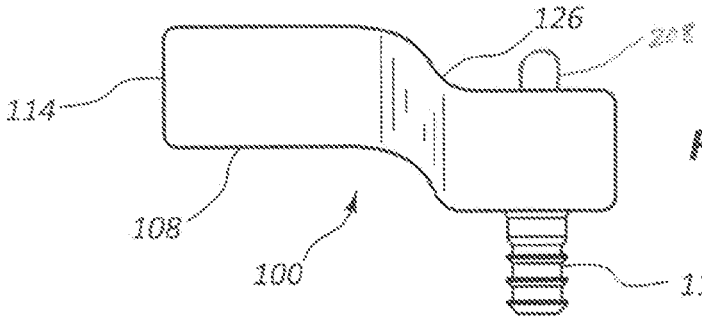
FIG. 2B shows a side view of the hearing device of FIG. 2A.
Figure 2C:
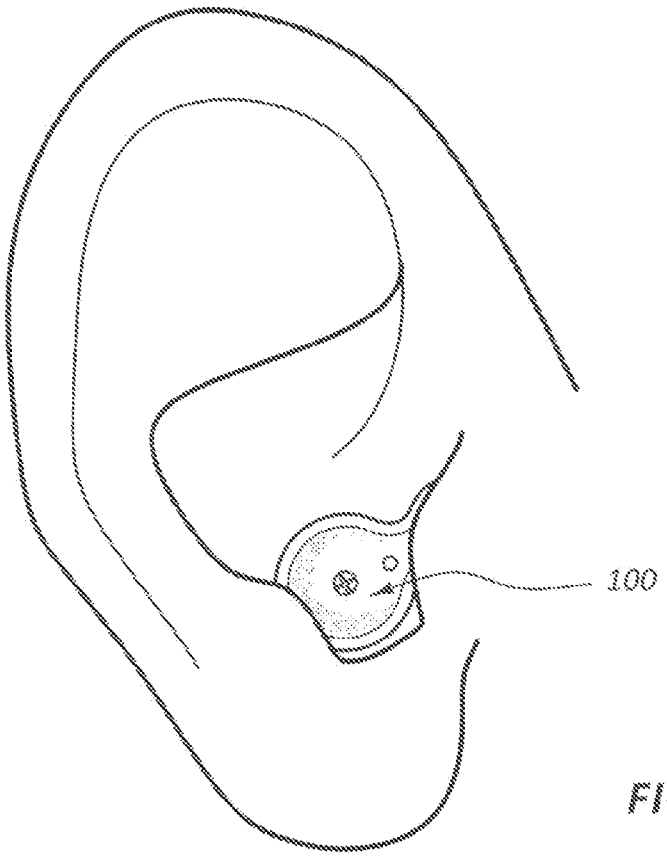
FIG. 2C shows the hearing device of FIG. 2A placed in an ear.

FIGS. 2A-2C show one example of a hearing device, generally indicated at 100, that may be used for total versatility in fitting various ear sizes and applications, while keeping the hearing device 100 all in the ear and not having to go behind the ear. This universal approach can serve all ears from children to adults or from small ear sizes to large ear sizes.

Figure 3:
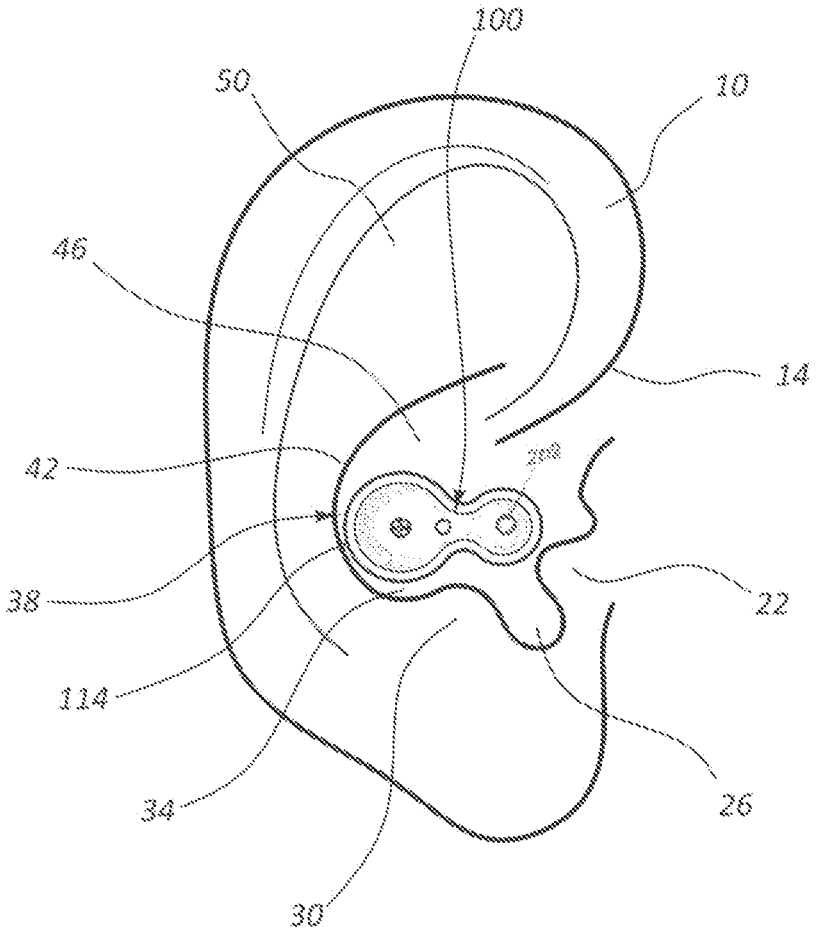
FIG. 3 shows a hearing device placed in an ear at a first position.
Figure 4:
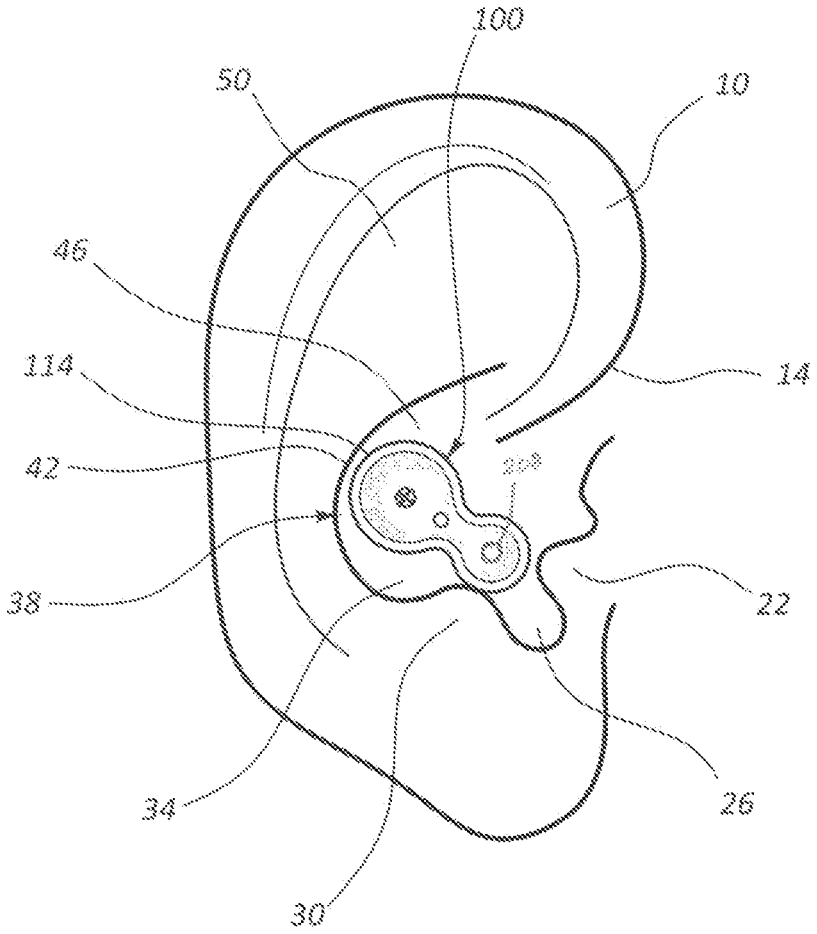
FIG. 4 shows the hearing device of FIG. 3 slidably engaged with the concha wall of the ear.

The hearing device 100 may comprise a housing 118 that defines an internal cavity in which a first microphone, an amplification circuit electrically connected to the first microphone, and a speaker electrically connected to the amplification circuit for amplifying ambient sound detected by the first microphone are located. The housing 118 may also have an arcuate outer edge 114. The arcuate outer edge 114 may be part of a larger circle 108 and configured to align with the concha area when the hearing device is placed in an ear (see FIG. 4). The arcuate outer edge 114 may allow the housing 118 to be placed in an ear (as shown in FIG. 3) and then engage the concha area of the ear by sliding the arcuate outer edge 114 along the concha wall 42 (as shown in FIG. 4), so that the hearing device 100 is stably and comfortably held in the ear regardless of the size of the particular ear.

In some embodiments, the hearing device may comprise a housing having a first section 108 with a substantially circular design and a second section 122 with a substantially circular design as shown in particular in FIGS. 2A and 2B. In at least one embodiment, the first section 108 is larger than the second section 122. Additionally, there may be a transition space 126 between the first section 108 and the second section 122. An outer edge of the first section 108 may be configured to align with the concha area when the hearing device 100 is placed in an ear while the second section aligns to the ear canal. This two-circle design may allow the hearing device to roll up or down in the outer ear according to whatever the person's ear shape or size is.

As will be appreciated by one skilled in the art, some conventional in-ear hearing instruments can plug the ear off, creating an uncomfortable plugged up feeling. By comparison, the hearing device 100 may have a design that allows for a true unplugged, open feeling while maintaining a small in the ear, hearing device for all ears. For example, the design may include a very slim port 110 (see FIG. 2B) that goes into the ear allowing an open ear tip to be placed on it, leaving the ear canal completely open and natural. Alternatively, a foam tip may be placed on the port for maximum hearing protection. This is a critical point to be able to provide an affordable, yet highly effective solution, for hearing enhancement or hearing protection to help tens of millions of Americans have easy access to effective solutions for their hearing needs. It will also be appreciated by one skilled in the art that the principles described herein may be applied to a variety of hearing devices such as hearing aids, PSAPs, etc.

On a general note, a two-circle design for a hearing device as described herein may allow for a universal fit for a variety of ears. In particular, the hearing device 100, may be able to roll up or down in the outer ear according to whatever the person's ear shape or size is. Additionally, it is believed by the inventor that the novel aspects of the hearing device 100 described herein, including the use of a slim port 110 that goes into the ear canal which is so small that it does not plug off the canal like all other in ear devices do, helps create the first in ear/open ear hearing device commercially available. In fact, the two-circle design is believed to be effective in fitting 98% of ears that it goes in.

Figure 5:
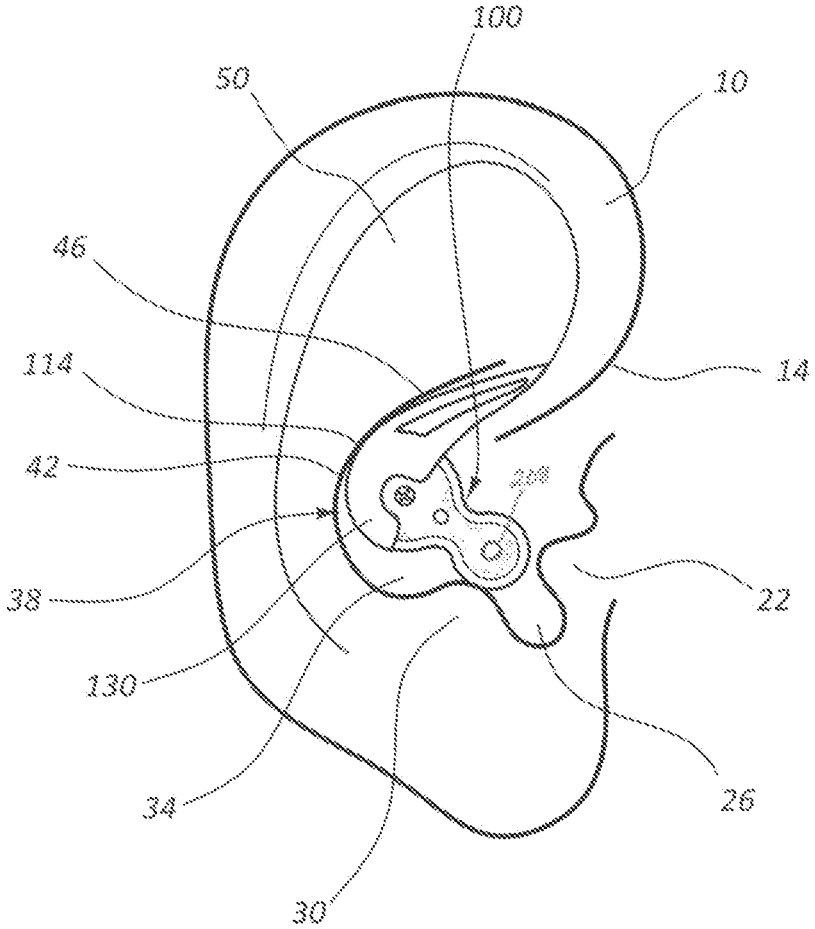
FIG. 5 shows an attachment member for securing a hearing device in an ear.

Turning now to FIG. 5 there is shown an attachment member 130 for engaging the housing of a hearing device. The attachment member 130 may releasably engage the hearing device to aid in the retention of the hearing device when the hearing device is placed in an ear. The attachment member 130 may be manufactured in a variety of sizes such that a user may choose a particular size that best fits his or her ear to provide a more customized fit that is more comfortable and secure.

Figure 6:
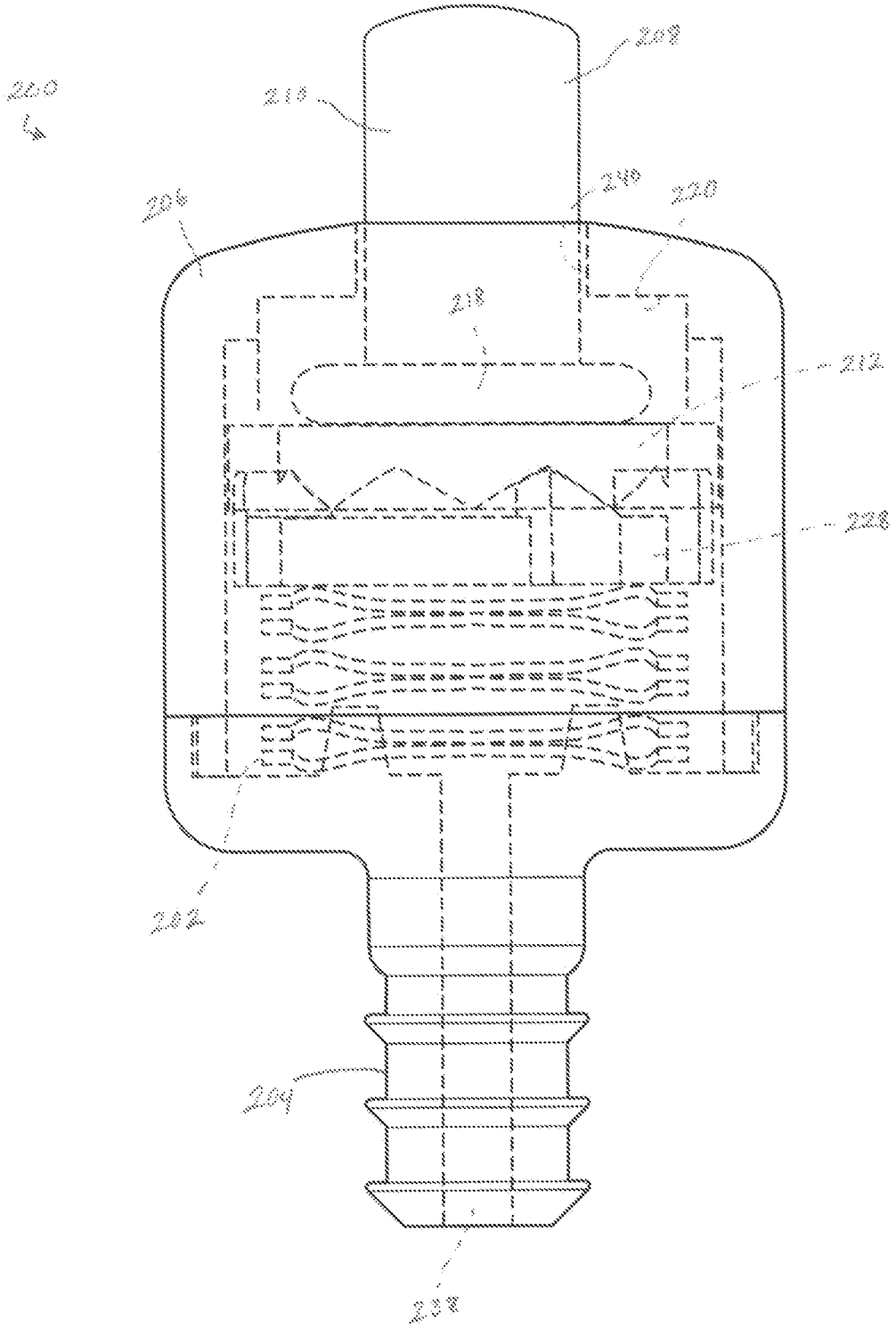
FIG. 6 shows an embodiment of a hearing device containing a slidable locking mechanism for a sound valve with the valve in an open position.
Figure 7:
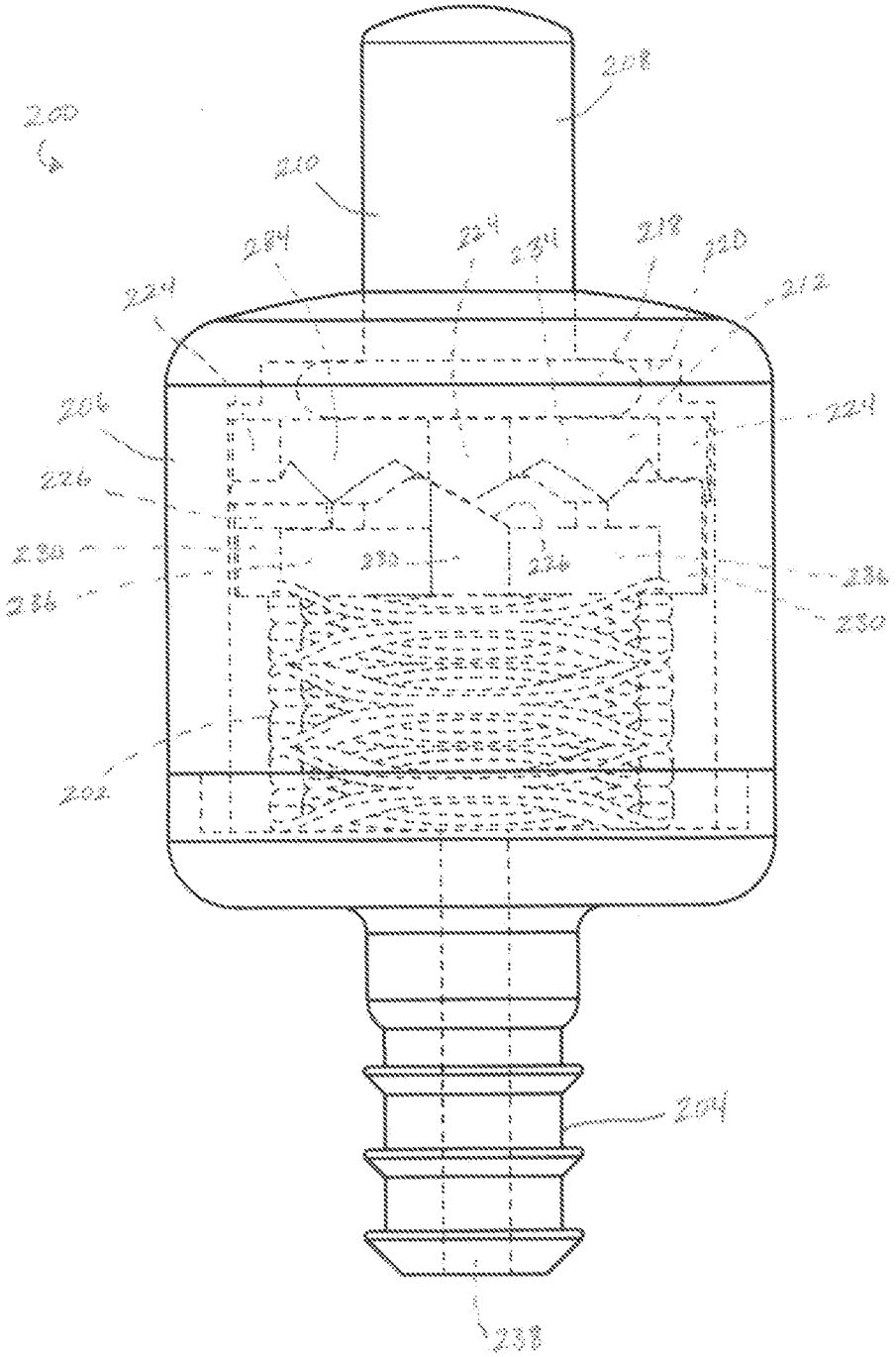
FIG. 7 shows the device of FIG. 6 with the valve in a closed position.
Figure 8:
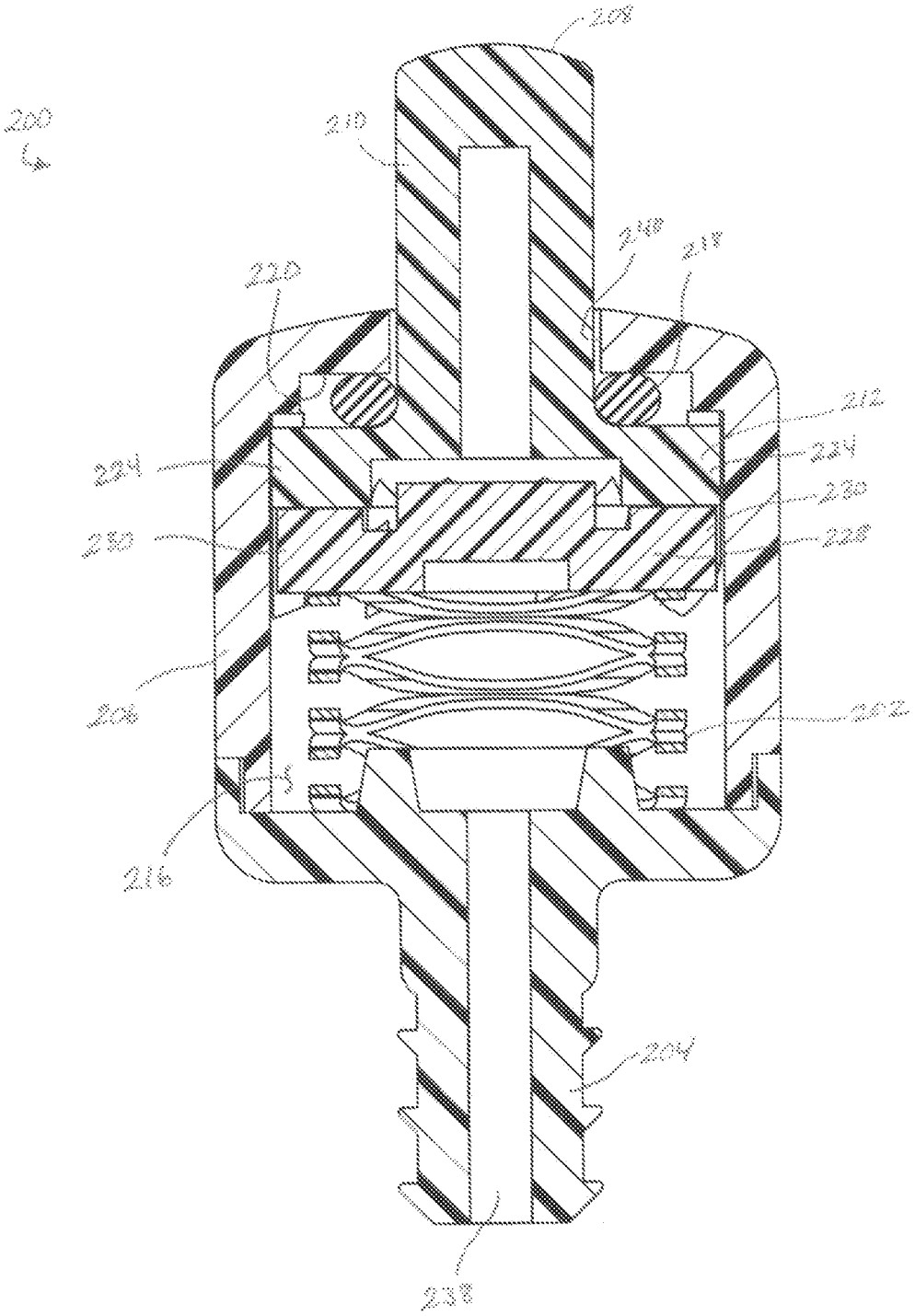
FIG. 8 is a section view of the device of FIG. 7.

FIGS. 6-8 show additional features of hearing devices disclosed herein. In these embodiments, the hearing device 100 may be embodied as an earplug with a sound valve that can be configured with a slidable locking mechanism (SLM) 200. The SLM 200 can be used to open (and close) a sound valve and lock it into an open position for normal hearing a closed position for no hearing/blocked hearing.

In some configurations, the SLM 200 comprises a spring member 202 that can be actuated by being pushed. When the earplug—and therefore the spring member—is pushed by a user, the sound channel in the earplug is opened and allows the user to hear normally. When it is pushed again, it closes and blocks the sound channel to stop hearing for improved hearing protection. The function of the SLM 200 is shown in detail in FIGS. 6-8 and will is described as follows.

Figure 6A:
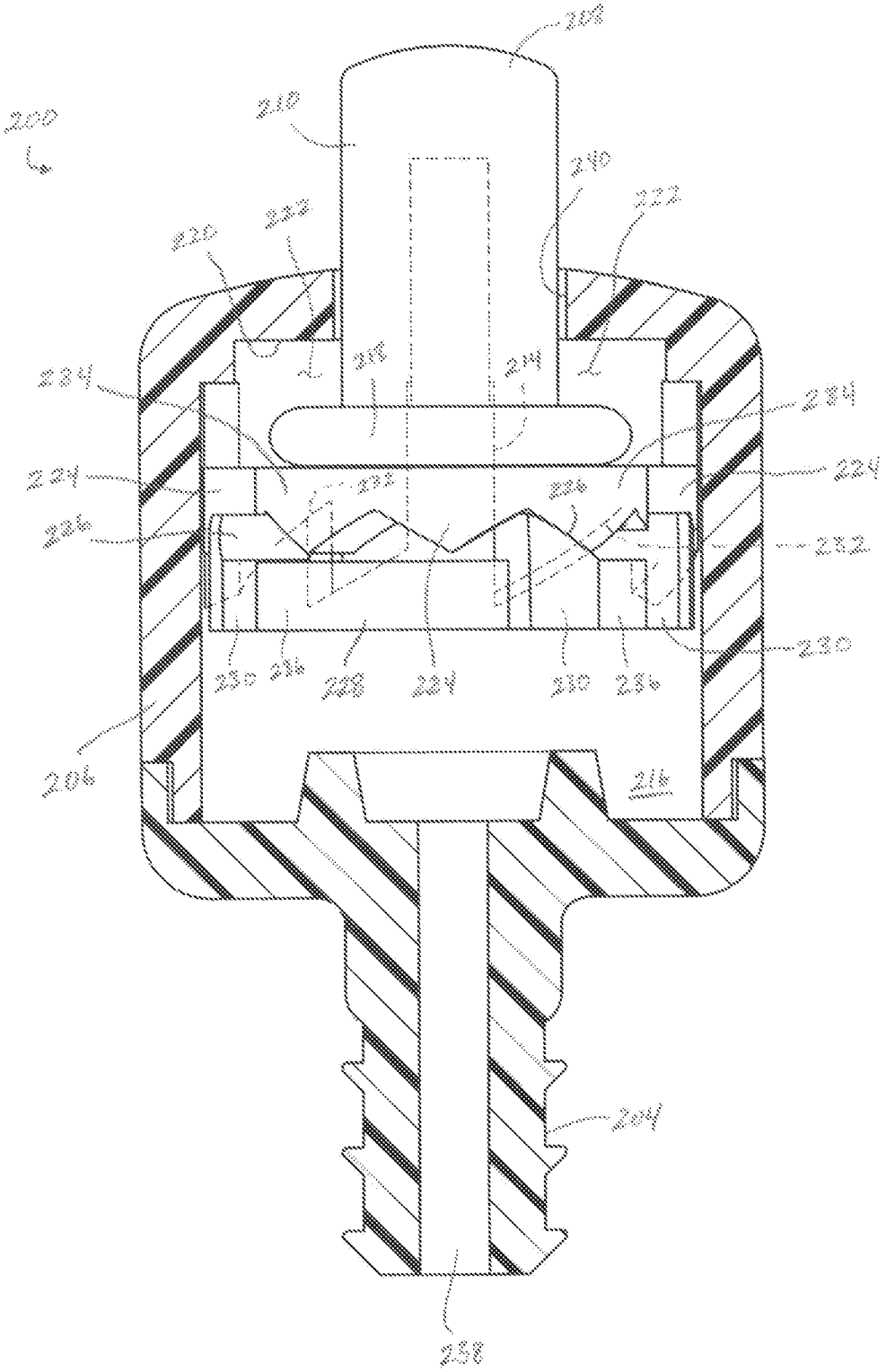
FIG. 6A shows a section view of the device of FIG. 6 with the spring removed.

The SLM 200 in FIGS. 6-8 comprises an ear canal stem 204 that extends proximally from an outer housing 206 within which the spring 202 is positioned. In FIG. 6A, the spring 202 is hidden. A custom ear tip (e.g., a foam or silicone tip) (not shown) may be attached to the exterior of the ear canal stem 204 for a customized, tight fit into the wearer's ear canal.

A retractable button 208 extends through the distal end of the outer housing 206 (i.e., through distal opening 240). The retractable button 208 comprises a stem 210 and a base engagement portion 212. The base engagement portion 212 has a plurality of angled protrusions 224 seated in a plurality of peripheral grooves 214 in the internal chamber 216 of the outer housing 206. Thus, when a proximally-directed force is applied to the stem 210 of the retractable button 208, the base engagement portion 212 translates proximally with the angled protrusions 224 within the peripheral grooves 214 of the internal chamber 216 toward the ear canal stem 204. When a distally-directed force is applied to the retractable button 208, the base engagement portion 212 slides longitudinally distally with the angled protrusions 224 in the grooves 214.

A gasket or o-ring 218 is positioned around the base of the stem 210 of the button 208. The o-ring 218 contacts a proximally-facing internal surface 220 of the internal chamber 216 of the outer housing 206 at the distal opening 240 when the button 208 is fully extended in the distal direction, and when the button 208 retracts into the outer housing 206, the o-ring 218 separates from the proximally-facing surface 220 and forms a gap 222 between the o-ring 218 and the internal chamber 216 as the o-ring 218 follows the motion of the stem 210.

The base engagement portion 212 of the button 208 comprises a plurality of angled protrusions 224 that extend proximally away from the stem 210 of the button 208. The angled protrusions 224 are configured to contact a plurality of angled surfaces 226 of a rotatable locking member 228 that is positioned between the base engagement portion 212 and the spring 202. The rotatable locking member 228 is biased toward the distal end of the outer housing 206 by the spring 202 to abut the angled protrusions 224 of the button 208.

The angled surfaces 226 on the rotatable locking member 228 are positioned on radial protrusions 230 of the rotatable locking member 228 that are movable between a closed position wherein the radial protrusions 230 are held in the grooves 214 and an open position wherein the radial protrusions 230 are held in angled seats 232 that are formed in the inner surface of the outer housing 206. See FIG. 7A. The geometry of the angled protrusions 224 and the angled surfaces 226 (and, in some embodiments, a rotational biasing force applied by the spring 202) causes the radial protrusions 230 to turn from being held in the grooves 214 to being held in the angled seats 232 when the button 208 is depressed proximally while the protrusions 230 are in the grooves 214 or to turn from being held in the angled seats 232 back to the grooves 214 when the button is depressed proximally while the protrusions 230 are in the seats 232.

With the protrusions 230 in the seats 232, the rotatable locking member 228 is prevented from moving distally beyond the seats 232, so the button 208 is not biased distally by the rotatable locking member 228 and spring 202. Thus, the o-ring 218 around the button 208 may stay in the "open" position, with the gap 222 formed, without a proximal force being applied to the button 208 to keep the o-ring 218 separated from the proximally-facing surface 220.

In some embodiments, the button 208 may be retained in the open position by friction between the inner surface of the internal chamber 216 and the radially-outward surfaces of the base engagement portion 212 of the button 208. In this manner, the button 208 tends to remain in the open position when opened rather than being loose in the distal opening 240 and potentially allowing the o-ring 218 to slide back into contact with the proximally-facing surface 220 inadvertently. However, the friction between the inner surface of the internal chamber 216 and the radially-outward surfaces of the base engagement portion 212 of the button 208 may not be so great as to prevent the base engagement portion 212 from sliding distally when acted upon by the spring 202 (via the rotatable locking member 228), however. Thus, the button 208 may move between the open and closed positions.

Figure 7A:
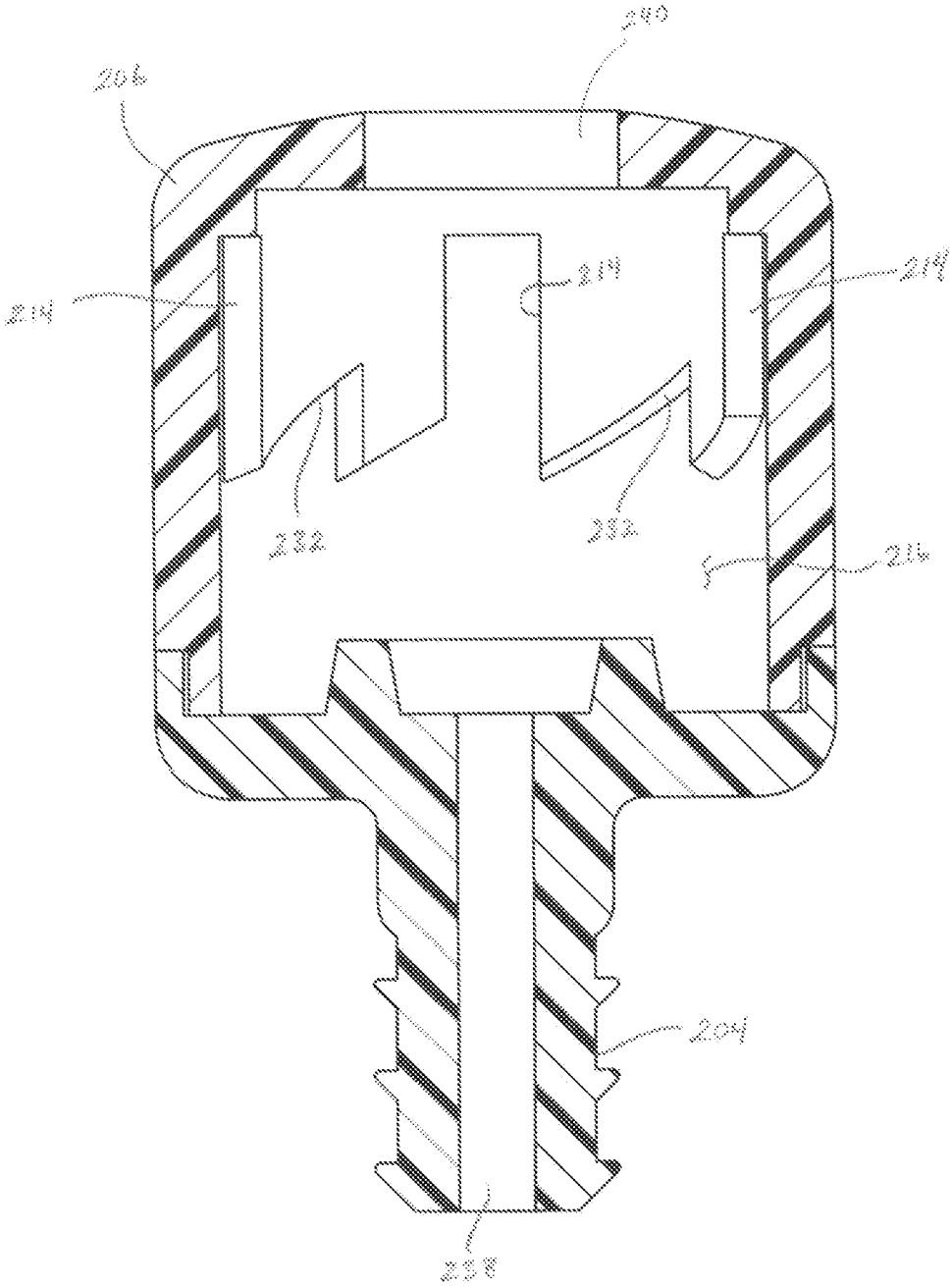
FIG. 7A is a section view of the housing of the device of FIG. 7.

The button 208 and rotatable locking member 228 may be partially spaced from the inner surfaces of the internal chamber 216 of the outer housing 206. A plurality of radially-narrowed surfaces 234, 236 may be positioned circumferentially between the angled protrusions 224 of the button 208 and the radial protrusions 230 of the rotatable locking member 228, respectively, as shown in FIG. 7A. The radially-narrowed surfaces 234, 236 may be spaced inward relative to the internal walls of the internal chamber 216. As shown in FIG. 6A, the stem 210 of the button 208 may also be spaced from the outer housing 206 at the distal opening 240, and the ear canal stem 204 may have a longitudinal channel 238. Thus, an open air channel is formed through the SLM 200 when the o-ring 218 is not sealing off the distal opening 240 due to the spaces between the stem 210 and the outer housing 206, the spaces between the radially-narrowed surfaces 234, 236 and the outer housing 206, the porosity of the spring 202, and the channel 238 of the ear canal stem 204. The open air channel allows sound waves to pass through the SLM 200, so the wearer has a high level of hearing sensitivity. With the o-ring 218 abutting the proximally-facing surface 220, the air channel is closed at the distal opening 240, so hearing is relatively blocked and obstructed.

These embodiments may allow the wearer to quickly change between hearing and obstructed configurations by a simple press of the button 208. The wearer does not have to remove the SLM 200 from his or her ear, or even look at the device, to be able to adjust hearing sensitivity. Further, a user or person observing the user can quickly and easily tell whether the SLM 200 is in an open or closed configuration due to observing the position of the stem 210 relative to the outer housing 206, since a retracted stem 210 indicates sensitive hearing and an extended stem 210 indicates obstructed hearing. This feature may be significant in applications such as at a firing range where a range manager or instructor can tell at a glance whether patrons are complying with ear protection rules.

In some embodiments, the stem 210 may comprise an indicating feature that is positioned on the outer surface of the stem 210. The indicating feature may comprise a colored band that extends peripherally around the stem 210, a pattern, etching, marking, or other indicating means that can be at least partially covered by the outer housing 206 when the stem 210 is in the open position (i.e., retracted into the outer housing 206). The indicating feature may therefore serve as an additional visual indicator showing whether the stem 208 is in a hearing or occluded position. For example, if the indicating feature is a colored red band around the stem 210, the red band may be visible when hearing is occluded but may be hidden from view when hearing is sensitive. Thus, an observer may immediately tell which position the stem 210 is in relative to the housing 206 simply by determining whether the red band is visible or covered, rather than having to gauge the relative position of the stem 210 and housing 206 (which, at least for beginners, may be challenging to do accurately and consistently). In another example, a small "X" or other symbol may be printed on the stem 210 that indicates that hearing is stopped when the "X" is visible and not stopped when the "X" is withdrawn into the outer housing 206.

In some configurations of these embodiments, the above-mentioned double circle design with interchangeable concha rings can be incorporated into an earplug for hearing protection purposes, as to provide the same unique fitting system for performance and effectiveness. These may include two additional unique features.

The first feature is a turn screw adjustable to open or close valve. There will be a sound filter in this device to allow one to easily open a valve to let more natural sound and hearing through or to close it for shutting off maximum sound for hearing protection. This will be accomplished through a finger adjustment that turns the outside of the valve forward to close the valve off for hearing protection or to turn it backwards to open the valve up letting sound come through for when one needs to hearing better. This will be a two-part valve that connects into each other. The one inner part will have a "V" shape in it that allows sound to pass through. The outer part will also have a "V" shape in it, so that when the two v shapes align, they will let full sound come through the device and when they are not aligned it will create a more solid plug than any filter on the market for maximum hearing protection. This will give a Noise Reduction Rating upwards of 27 dB, better than any sound valve on the market.

The second feature includes interchangeable tips for silicone or foam. This sound valve will also have a systemized tip on the end so the person can switch from a silicone tip or to a foam tip according to their needs for maximum hearing protection or comfort. This allows someone to place a foam tip on instead will give them the ability to obtain a 30 dB Noise Reduction Rating compared to the 10-24 dB NRR range on most sound filtered ear plugs.

In addition to any previously indicated modification, numerous other variations and alternative arrangements may be devised by those skilled in the art without departing from the spirit and scope of this description, and appended claims are intended to cover such modifications and arrangements. Thus, while the information has been described above with particularity and detail in connection with what is presently deemed to be the most practical and preferred aspects, it will be apparent to those of ordinary skill in the art that numerous modifications, including, but not limited to, form, function, manner of operation and use may be made without departing from the principles and concepts set forth herein. Also, as used herein, the examples and embodiments, in all respects, are meant to be illustrative only and should not be construed to be limiting in any manner.

The invention claimed is:

1. A hearing device, comprising:

a housing having an internal chamber, the internal chamber having a distal opening in a distally-facing surface of the housing, the distal opening configured to face away from an ear canal of a user;

an ear canal stem extending proximally from the housing and configured to be inserted into the ear canal of the user;

a button having a stem and a base engagement portion, the stem extending through the distal opening opposite the ear canal stem, the base engagement portion configured to translate within the internal chamber of the housing between a distal position wherein an air passage through the distal opening, internal chamber, and ear canal stem is closed and a proximal position wherein the air passage through the distal opening, internal chamber, and ear canal stem is open, the air passage at least partially extending through the distal opening between the ear canal stem and the distal opening.

2. The hearing device of claim 1, further comprising a biasing member positioned in the internal chamber and configured to bias the button toward the distal position.

3. The hearing device of claim 2, further comprising a rotatable locking member positioned between the button and the biasing member, the rotatable locking member being adjustably movable between a first rotated position and a second rotated position, the second rotated position being proximal of the first rotated position.

4. The hearing device of claim 1, further comprising a gasket member positioned peripherally around the stem of the button, the gasket member sealing off the distal opening when the base engagement portion is in the distal position.

5. The hearing device of claim 4, wherein the gasket member is configured to contact a proximally-facing surface of the internal chamber when the button is in the distal position.

6. The hearing device of claim 1, wherein application of a longitudinal force to the button adjusts the button between the distal position and the proximal position.

7. The hearing device of claim 1, wherein application of a longitudinal force to the button adjusts the button between the proximal position and the distal position.

8. The hearing device of claim 1, wherein the button is a valve member configured to seal or open the distal opening.

9. The hearing device of claim 1, further comprising an indicating feature on the stem of the button.

10. The hearing device of claim 9, wherein the indicating feature is positioned at a base portion of the stem relative to the base engagement portion.

11. The hearing device of claim 1, wherein the base engagement portion comprises a radially-narrowed surface, the radially-narrowed surface being spaced inward from the internal chamber of the housing.

12. The hearing device of claim 1, wherein the air passage extends through the distal opening, around the button, and through the ear canal stem.

13. The hearing device of claim 1, further comprising a flexible tip member, the flexible tip member being configured to be positioned between an ear canal and the ear canal stem.

14. The hearing device of claim 1, wherein the button is retained against the internal chamber in the proximal position by friction.

15. A method of controlling the transmission of sound through a hearing device, the method comprising:

inserting a hearing device into an ear canal, the hearing device comprising a housing having an internal chamber and a button at least partially within the internal chamber;

applying a proximal force to the button to slide the button proximally into the internal chamber and to open an air passage through the hearing device into the ear canal, the air passage extending between the button and a distal opening in the housing.

16. The method of claim 15, further comprising applying a proximal force to the button and releasing the proximal force to allow the button to move distally to close the air passage.

17. The method of claim 15, wherein applying the proximal force compresses a biasing member in the internal chamber, the biasing member applying a distal force to the button.

18. The method of claim 15, wherein applying the proximal force rotates a rotatable locking member within the internal chamber between a distally-movable position and a distally-restrained position.

19. The method of claim 18, wherein abutting angled surfaces of the button and the rotatable locking member slide against each other to rotate the rotatable locking member.

20. A hearing device, comprising:

a housing having an internal chamber, the internal chamber having a distal opening;

an ear canal stem extending from the housing and configured to be inserted into an ear canal;

a button having a stem and a base engagement portion, the stem extending through the distal opening, the base engagement portion configured to translate within the internal chamber of the housing between a distal position wherein an air passage is closed and a proximal position wherein the air passage is open, the air passage extending through the housing and at least partially between the ear canal stem and the distal opening;

an indicating feature on the stem of the button.

21. The hearing device of claim 20, wherein the indicating feature is positioned at a base portion of the stem relative to the base engagement portion.

22. A hearing device, comprising:

a housing having an internal chamber, the internal chamber having a distal opening in a distally-facing surface of the housing, the distal opening configured to face away from an ear canal of a user;

an ear canal stem extending proximally from the housing and configured to be inserted into the ear canal of the user;

a button having a stem and a base engagement portion, the stem extending through the distal opening opposite the ear canal stem, the base engagement portion configured to translate within the internal chamber of the housing between a distal position wherein an air passage through the distal opening, internal chamber, and ear canal stem is closed and a proximal position wherein the air passage through the distal opening, internal chamber, and ear canal stem is open;

wherein the button is a valve member configured to seal or open the distal opening.

23. A hearing device, comprising:

a housing having an internal chamber, the internal chamber having a distal opening in a distally-facing surface of the housing, the distal opening configured to face away from an ear canal of a user;

an ear canal stem extending proximally from the housing and configured to be inserted into the ear canal of the user;

a button having a stem and a base engagement portion, the stem extending through the distal opening opposite the ear canal stem, the base engagement portion configured to translate within the internal chamber of the housing between a distal position wherein an air passage through the distal opening, internal chamber, and ear canal stem is closed and a proximal position wherein the air passage through the distal opening, internal chamber, and ear canal stem is open;

wherein the air passage extends through the distal opening, around the button, and through the ear canal stem.

* * * * *